US011718469B2

(12) United States Patent
Tsuda

(10) Patent No.: US 11,718,469 B2
(45) Date of Patent: Aug. 8, 2023

(54) ARTICLE REVERSING/DISCHARGING BOX AND METHOD OF USING ARTICLE REVERSING/DISCHARGING BOX

(71) Applicant: TSUDA KOGYO CO., LTD., Kakamigahara (JP)

(72) Inventor: Yoshihisa Tsuda, Kakamigahara (JP)

(73) Assignee: TSUDA KOGYO CO., LTD., Kakamigahara (JP)

( * ) Notice: Subject to any disclaimer, the term of this patent is extended or adjusted under 35 U.S.C. 154(b) by 0 days.

(21) Appl. No.: 17/922,217

(22) PCT Filed: Jan. 31, 2022

(86) PCT No.: PCT/JP2022/003500
§ 371 (c)(1),
(2) Date: Oct. 28, 2022

(87) PCT Pub. No.: WO2023/037572
PCT Pub. Date: Mar. 16, 2023

(65) Prior Publication Data

US 2023/0192394 A1 Jun. 22, 2023

(30) Foreign Application Priority Data

Sep. 10, 2021 (JP) ..... 2021-147439

(51) Int. Cl.
*B65D 88/56* (2006.01)

(52) U.S. Cl.
CPC ..... *B65D 88/56* (2013.01); *B65D 2588/12* (2013.01); *B65D 2588/54* (2013.01)

(58) Field of Classification Search
CPC ..... B65D 90/0033; B65D 88/546; B65D 88/566; B65D 2588/54; B65D 2588/12
(Continued)

(56) References Cited

U.S. PATENT DOCUMENTS 4,325,669 A * 4/1982 Schafer ..... B66F 9/19 414/785
4,405,278 A * 9/1983 Kvalheim ..... B65F 1/1452 414/404
(Continued)

FOREIGN PATENT DOCUMENTS

JP 3-25403 U 3/1991
JP 3-62003 U 6/1991
(Continued)

OTHER PUBLICATIONS

Written Opinion of the International Searching Authority dated Mar. 8, 2022, issued in counterpart International Application No. PCT/JP2022/003500 with English translation (7 pages).
(Continued)

*Primary Examiner* — Glenn F Myers
(74) *Attorney, Agent, or Firm* — WHDA, LLP

(57) ABSTRACT

An article reversing/discharging box 1 includes a box main body 2 that accommodates scrap, hook members 3, 4 having insertion holes 3*a*, 4*a* through which forks of a forklift are inserted above the box main body 2, and a reversing mechanism 5 capable of reversing the box main body 2. The reversing mechanism 5 includes a bottom plate 6 integrally extending from a lower end of the movable hook member 4 along the bottom surface 2*d*, and a hinge 7 provided at a distal end portion of the bottom plate 6. When the forks are inserted into the insertion holes 4*a* of the movable hook member 4 and the forks are removed from the insertion holes 3*a* of the fixed hook members 3, the box main body 2 is turnable about the distal end portion of the bottom plate 6 by the hinge 7.

8 Claims, 19 Drawing Sheets

(58) Field of Classification Search
USPC ..... 414/425, 424, 404, 810
See application file for complete search history.

(56) References Cited

U.S. PATENT DOCUMENTS

| | | | | |
|---|---|---|---|---|
| 4,408,946 | A * | 10/1983 | Haven | B66F 9/19 414/404 |
| 2012/0181214 | A1* | 7/2012 | Kernen | B65F 1/1468 206/596 |

FOREIGN PATENT DOCUMENTS

| | | | |
|---|---|---|---|
| JP | 6-191603 | A | 7/1994 |
| JP | 6-263145 | A | 9/1994 |
| JP | 3172827 | U | 1/2012 |

OTHER PUBLICATIONS

International Search Report dated Jan. 31, 2022, issued in counterpart International Application No. PCT/JP2022/003500, in Japanese. (3 pages).

* cited by examiner

ARTICLE REVERSING/DISCHARGING BOX AND METHOD OF USING ARTICLE REVERSING/DISCHARGING BOX

TECHNICAL FIELD

The present invention relates to an article reversing/discharging box that is reversed by a forklift to discharge an accommodated article, and a method of using the article reversing/discharging box.

BACKGROUND ART

Conventionally, scrap boxes disclosed in Patent Literatures 1 and 2 are known as discharging boxes for discharging articles accommodated by a forklift. In the scrap box of Patent Literature 1, when the fork is inclined front-downward at the scrap discharge position, the scrap box and a lifting frame (32) of the forklift are coupled by the coupling tool (31), so that engagement of a disengagement pair (40) is released, the opening/closing side plate (4) is opened, and the scrap is discharged. In the scrap box of Patent Literature 2, when a lead wire (34) is towed after a lock fixing pin (52) is removed at the scrap discharge position, a swing member (46) is swung to release the lock engagement between a clasp (40) and a hook hole (48), and a bottom lid (14) is opened to discharge the scrap. As described above, according to the scrap boxes of Patent Literatures 1 and 2, it is not necessary to open the opening/closing side plate (4) and the bottom lid (14) by manual operation when discharging the scrap, the safety of the worker is secured, and the work load is also reduced.

CITATIONS LIST

Patent Literature

Patent Literature 1: Japanese Unexamined Patent Application Publication No. 6-263145

Patent Literature 2: Japanese Unexamined Utility Model Application Publication No. 3-25403

SUMMARY OF INVENTION

Technical Problems

However, in the discharging box of Patent Literature 1, since there is no sufficient rotation angle in the discharging box when discharging the scrap, the scrap cannot be completely discharged, and the worker has to get off the forklift and manually scrape out the remaining scrap. Furthermore, it is necessary for the worker to close the opening/closing side plate (4) after discharging the scrap, and to lock the closed state with the disengagement pair (40). In addition, when the scrap box is loaded and unloaded to and from the forklift, the scrap box and the lifting frame (32) of the forklift must be coupled or decoupled by the coupling tool (31). Furthermore, in the scrap box of Patent Literature 2, when the scrap box is unloaded on the floor surface after the scrap is discharged, the bottom lid (14) is automatically locked to the container main body (12) by the load of the scrap box and the action of the counterweight (52), but the worker has to get off the forklift and remove the lock fixing pin (52) from the lock member (38) before the scrap is discharged. Moreover, after the scrap is discharged and the scrap box is unloaded on the floor surface, the worker has to get off the forklift and insert the lock fixing pin (52) into the lock member (38). Therefore, in the scrap boxes of Patent Literatures 1 and 2, the worker has to get on and off the forklift many times, and the load of the worker is not sufficiently reduced. In addition, the worker must touch the scrap box and the like, and handling is troublesome particularly when measures against infectious diseases and the like are required. Furthermore, the structure is complicated, the number of parts is large, and the manufacturing cost is high.

The present invention has been made in view of such conventional problems, and provides an article reversing/discharging box and a method of using the article reversing/discharging box, capable of reducing a load of a worker, allowing an article discharging work without the worker getting of the forklift, and being manufactured at low cost.

Solutions to Problems

In order to solve the above problem, the feature of an article reversing/discharging box according to claim 1 is an article reversing/discharging box that is reversed by a forklift to discharge an accommodated article, the article reversing/discharging box including: a box main body that accommodates the article; hook members provided facing the box main body and have insertion holes through which forks of the forklift are inserted above the box main body; and a reversing mechanism capable of reversing the box main body, where the box main body includes a bottom surface having a flat surface shape, a first wall surface provided upright on an outer periphery of the bottom surface, and a second wall surface provided upright on an outer periphery of the bottom surface facing the first wall surface, the hook members include fixed hook members that are fixed to the second wall surface, and a movable hook member that is provided on the first wall surface and extends upward from a lower end of the box main body along the first wall surface, the reversing mechanism includes a bottom plate integrally extending from a lower end of the movable hook member along the bottom surface, and a reversing member provided at a distal end portion of the bottom plate, and when the forks are inserted into the insertion holes of the movable hook member and the forks are removed from the insertion holes of the fixed hook members, the box main body is turnable about the distal end portion of the bottom plate by the reversing member.

The feature of the article reversing/discharging box according to claim 2 is that the box main body has a rectangular parallelepiped shape in claim 1.

The feature of the article reversing/discharging box according to claim 3 is that the reversing member is a hinge in claim 1 or 2.

The feature of the article reversing/discharging box according to claim 4 is that the second wall surface of the box main body is provided with a turn assisting member that assists the turning of the box main body in any one of claims 1 to 3.

The feature of the article reversing/discharging box according to claim 5 is that the fixed hook members each have a leg portion formed by extending the fixed hook member downward in any one of claims 1 to 4.

The feature of the article reversing/discharging box according to claim 6 is that casters are attached to the bottom surface of the box main body according to any one of claims 1 to 4.

The feature of the article reversing/discharging box according to claim 7 is that a stopper for positioning to reverse the box main body and discharge an article is attached to the bottom surface of the box main body in any one of claims 1 to 6.

The feature of a method of using an article reversing/discharging box according to claim 8 is a method of using an article reversing/discharging box using the article reversing/discharging box according to any one of claims 1 to 7, the method including: a transport process of inserting the forks of the forklift into the insertion holes of the hook members of the article reversing/discharging box in which an article is accommodated, and then transporting the article reversing/discharging box to an article discharge place while lifting the article reversing/discharging box; a discharge process of removing the forks from the insertion holes of the fixed hook members while the forks are inserted into the insertion holes of the movable hook member at a predetermined position of the article discharge place, and reversing the box main body to discharge the article; and a return process of returning the box main body to an original state.

Advantageous Effects of Invention

In the article reversing/discharging box according to claim 1, when the forks are inserted into the insertion holes of the movable hook member and the forks are removed from the insertion holes of the fixed hook members, the box main body is turnable about the distal end portion of the bottom plate by the reversing member. Thus, when the worker removes the forks from the insertion holes of the fixed hook members while the forks are inserted into the insertion holes of the movable hook member, the box main body can be reversed or returned to the original state. Therefore, the worker can perform a series of works from the conveyance of the article reversing/discharging box to the discharge of the article and the return of the box main body while riding on the forklift. Therefore, the worker does not get off the forklift not even once in all of the processes of the discharging work, and does not touch the article reversing/discharging box. In addition, since the article reversing/discharging box includes only the box main body, the hook members, and the reversing mechanism, the structure is simple and the number of parts is small. Therefore, according to the article reversing/discharging box, the load of the worker is reduced, the worker can perform the article discharging work without getting off the forklift, and it can be inexpensively manufactured.

Note that the articles include all things such as food, medicine, and waste that can withstand impact at the time of discharge, and include articles that are weak against impact as long as they are packaged to withstand the impact. Furthermore, the material of the box main body is not limited to metal, and resin, wood, and the like can also be used. In addition, only the frame may be assembled with metal, and a resin box, a styrene foam box, or the like may be fitted into the frame to form a box main body.

In the article reversing/discharging box according to claim 2, in claim 1, since the box main body has a rectangular parallelepiped shape, it is easy to manufacture and also easy to handle.

In the article reversing/discharging box according to claim 3, in claim 1 or 2, since the reversing member is a hinge, the structure is simple and inexpensive. Moreover, when the forks are removed from the insertion holes of the fixed hook members while the forks are inserted into the insertion holes of the movable hook member, the box main body can be easily reversed or returned to the original state. That is, in this state, if the forks are raised to lift the article reversing/discharging box, the box main body is reversed. In addition, if the forks are lowered is and the article reversing/discharging box is lowered to the floor surface or the ground, the box main body can be returned to the original state.

In the article reversing/discharging box according to claim 4, in any one of claims 1 to 3, the turn assisting member that assists the turning of the box main body is provided on the second wall surface of the box main body, and thus when the forks are lowered to lower the article reversing/discharging box to the floor surface or the ground, the box main body can be easily returned to the original state.

In the article reversing/discharging box according to claim 5, in any one of claims 1 to 4, since the fixed hook members each have a leg portion formed by extending the fixed hook member downward, the bottom surface of the box main body can be separated from the floor surface or the ground with a simple structure.

In the article reversing/discharging box according to claim 6, in any one of claims 1 to 4, casters are attached to the bottom surface of the box main body, and thus the bottom surface of the box main body can be separated from the floor surface or the ground. In addition, when the forks are lowered to lower the article reversing/discharging box to the floor surface or the ground and return the box main body to the original state, the box main body can be appropriately moved by the casters, so that the work is facilitated.

In the article reversing/discharging box according to claim 7, in any one of claims 1 to 6, a stopper for positioning to reverse the box main body and discharge an article is attached to the bottom surface of the box main body, and thus the article can be reliably and easily discharged to a predetermined position.

In the method of using the article reversing/discharging box according to claim 8, in the transport process, the forks of the forklift are inserted into the insertion holes of the hook members, and the article reversing/discharging box is transported to the article discharge place while being lifted up. In the discharge process, the worker removes the forks from the insertion holes of the fixed hook members while the forks are inserted into the insertion holes of the movable hook member, and then reverses the box main body with the reversing member to discharge the article. Furthermore, in the return process, the box main body is returned to the original state by the reversing member. Thus, when the worker removes the forks from the insertion holes of the fixed hook members while the forks are inserted into the insertion holes of the movable hook member, the box main body can be reversed or returned to the original state. Therefore, the worker can perform a series of works from the conveyance of the article reversing/discharging box to the discharge of the article and the return of the box main body while riding on the forklift. Therefore, the worker does not get off the forklift not even once in all of the processes of the discharging work, and does not touch the article reversing/discharging box. Therefore, according to the method of using the article reversing/discharging box, the load of the worker is reduced, and the worker can perform the article discharging work without getting off the forklift.

DESCRIPTION OF EMBODIMENTS

Figure 1:
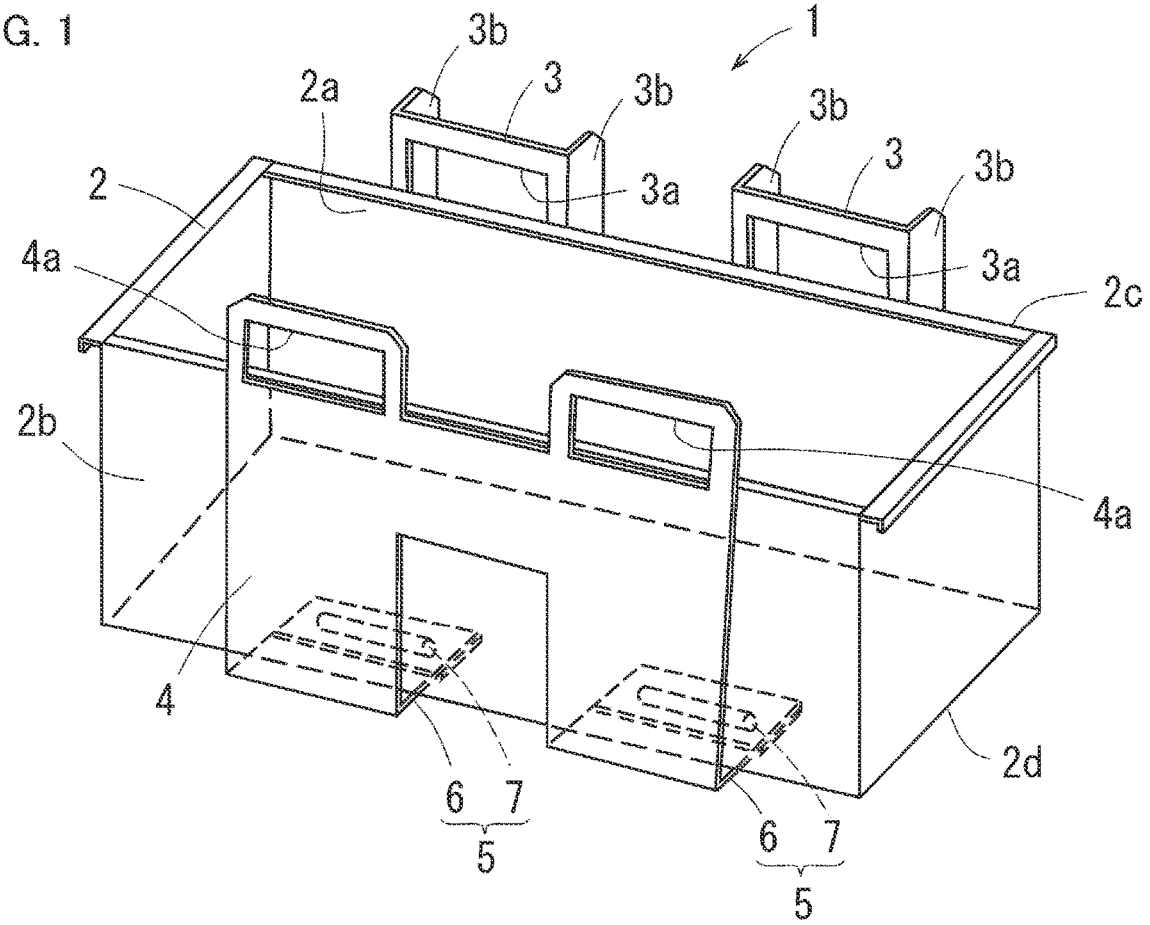
FIG. 1 relates to an article reversing/discharging box and a method of using the article reversing/discharging box according to an embodiment, and is a perspective view of the article reversing/discharging box.
Figure 2:
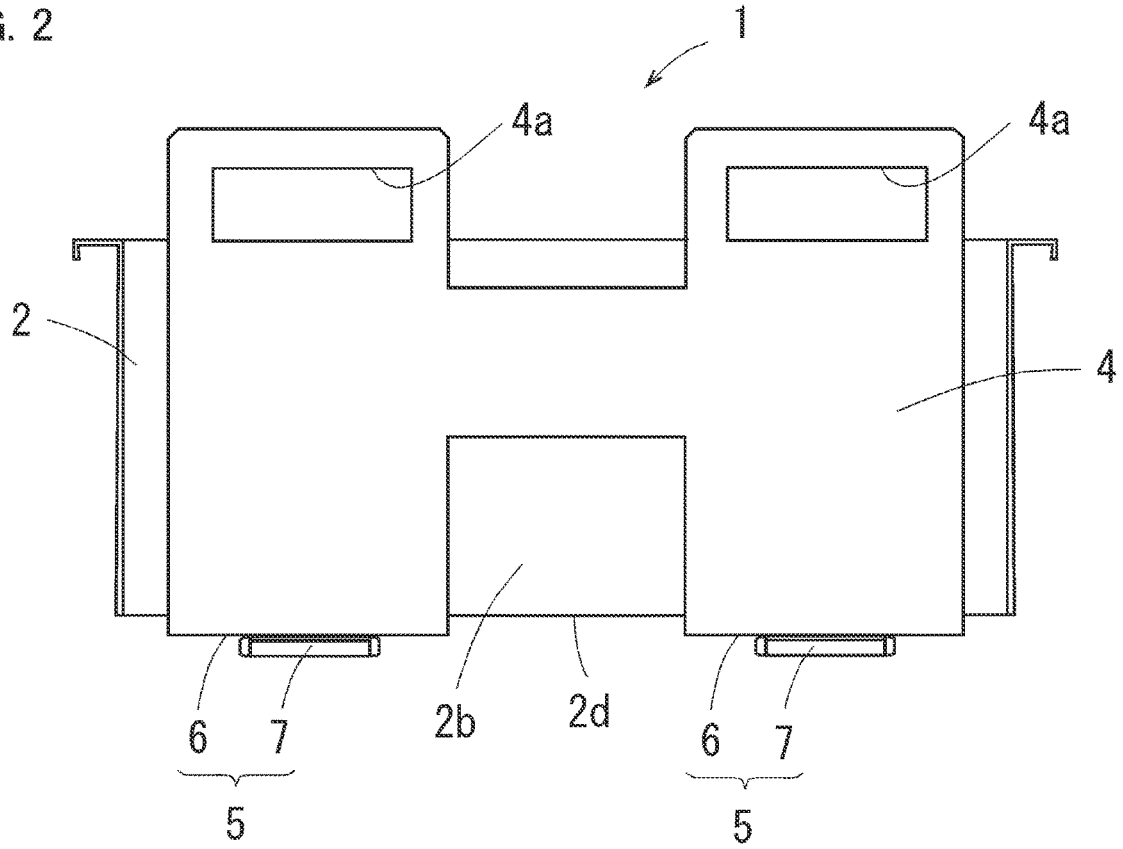
FIG. 2 relates to the article reversing/discharging box and the method of using the article reversing/discharging box according to an embodiment, and is a front view of the article reversing/discharging box.
Figure 3:
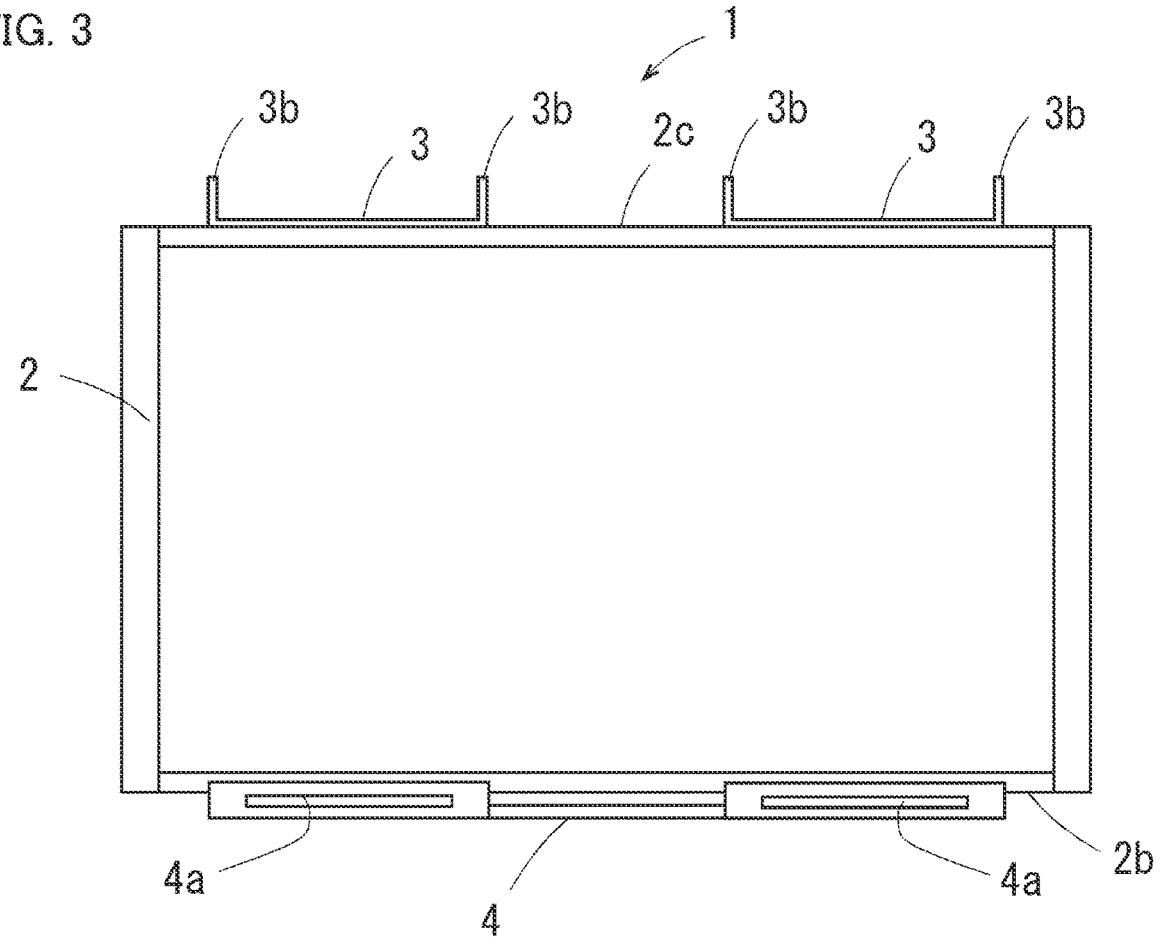
FIG. 3 relates to the article reversing/discharging box and the method of using the article reversing/discharging box according to an embodiment, and is a plan view of the article reversing/discharging box.

An embodiment in which an article reversing/discharging box and a method of using the article reversing/discharging box according to the present invention are embodied as a scrap box and a method of using the scrap box will be described below based on the drawings. First, the scrap box will be described with reference to FIGS. 1 to 5. FIGS. 1 to 5 are a perspective view, a front view, a plan view, a rear view, and a side view of a scrap box 1 serving as an article reversing/discharging box. The scrap box 1 is placed in the vicinity of a machine tool and temporarily stores scrap serving as an article generated with work such as cutting and polishing. Then, when the scrap box 1 is filled with scrap, the scrap box 1 is transported to a container which is an article discharge place by a forklift, and the scrap is discharged into the container. Thereafter, the scrap box 1 is returned to a predetermined position by the forklift.

As illustrated in FIGS. 1 to 5, the scrap box 1 includes a box main body 2, hook members 3 and 4, and a reversing mechanism 5. The box main body 2 has a rectangular parallelepiped shape having a bottom surface 2*d* having a flat surface shape, a front surface 2*b* serving as a first wall surface provided upright on the outer periphery of the bottom surface, and a rear surface 2*c* serving as a second wall surface provided upright on the outer periphery of the bottom surface 2*d* facing the front surface 2*b*. The scrap is accommodated in an accommodation space 2*a* opened on the upper side of the box main body 2. Furthermore, the hook members 3 and 4 include fixed hook members 3 fixed to the rear surface 2*c* of the box main body 2 and a movable hook member 4 provided on the front surface 2*b* and extending upward from the lower end of the box main body 2 along the front surface 2*b*. Insertion holes 3*a* and 4*a* are formed in the fixed hook members 3 and the movable hook member 4, respectively, on the upper side of the box main body 2. The scrap box 1 can be transported and scraps can be discharged by inserting the forks of the forklift into the insertion holes 3*a* and 4*a*.

The reversing mechanism 5 includes a bottom plate 6 integrally extending from a lower end of the movable hook member 4 along the bottom surface 2*d* of the box main body 2, and a hinge 7 serving as a reversing member provided at a distal end portion of the bottom plate 6. In this way, since the hinge 7 is used as the reversing member, the structure is simple and inexpensive. When the forks of the forklift are removed from the insertion holes 3*a* of the fixed hook members 3 while the forks are inserted into the insertion holes 4*a* of the movable hook member 4 by the reversing mechanism 5, the box main body 2 is turnable about the distal end portion of the bottom plate 2*d*. Accordingly, the scrap can be discharged from the accommodation space 2*a* of the box main body 2, and the box main body 2 can be returned to the original state. That is, the forks of the forklift are removed from the insertion holes 3*a* of the fixed hook members 3 while the forks are inserted into the insertion holes 4*a* of the movable hook member 4, and the forks are raised to lift the scrap box 1, so that the box main body 2 is reversed. In addition, if the forks are lowered as is and the scrap box 1 is lowered to the floor surface or the ground, the box main body 2 can be returned to the original state.

Figure 5:
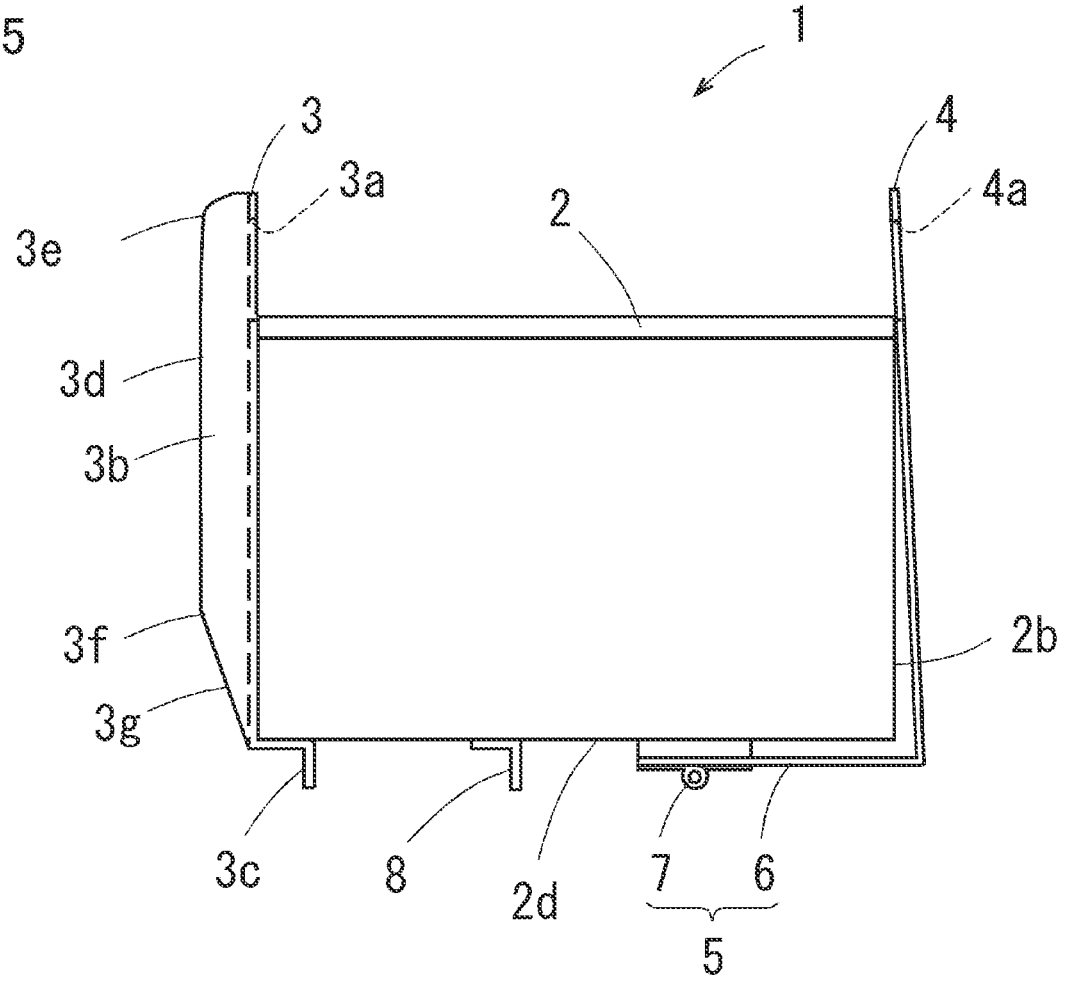
FIG. 5 relates to the article reversing/discharging box and the method of using the article reversing/discharging box according to an embodiment, and is a side view of the article reversing/discharging box.

The rear surface 2*c* of the box main body 2 is provided with turn assisting members 3*b* that assist the turning of the box main body 2. The turn assisting members 3*b* are formed integrally with each of the fixed hook members 3 by bending left and right ends of the fixed hook member 3 at a right angle. As illustrated in FIG. 5, each of the turn assisting members 3*b* has a substantially right-angled trapezoidal shape, and has a first fulcrum portion 3*e* and a second fulcrum portion 3*f* at both ends of a straight portion 3*d*. In addition, an inclined portion 3*g* which is gently inclined from the second fulcrum portion 3*f* toward the box main body 2 is formed. When the forks are lowered by the turn assisting member 3*b* to lower the scrap box 1 to the floor surface or the ground, the box main body 2 easily returns to the original state.

Figure 4:
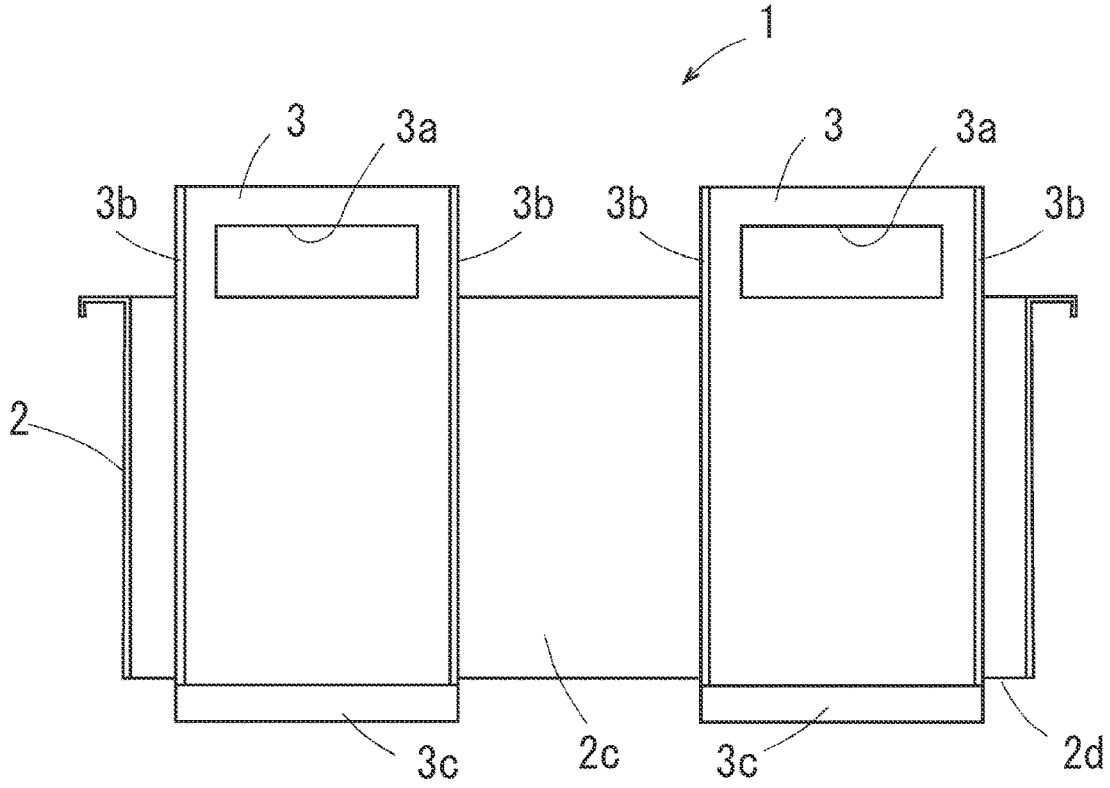
FIG. 4 relates to the article reversing/discharging box and the method of using the article reversing/discharging box according to an embodiment, and is a rear view of the article reversing/discharging box.

As illustrated in FIGS. 4 and 5, each of the fixed hook members 3 has a leg portion 3*c* formed integrally by extending the fixed hook member 3 downward. The distal end of the leg portion 3*c* and the distal end of the hinge 7 are abutted to the floor surface or the ground to separate the bottom surface 2*d* of the box main body 2 from the floor surface or the ground. Thus, the bottom surface 2*d* of the box main body 2 can be separated from the floor surface or the ground with a simple structure by the leg portion 3*c*.

As shown in FIG. 5, a stopper 8 formed of an L angle for positioning to reverse the box main body 2 and discharge the scrap is attached to the bottom surface 2*d* of the box main body 2. The stopper 8 facilitates safe and reliable discharge of scrap to a predetermined position. That is, when the stopper 8 is brought into contact with the upper end of the wall surface of the container at the time of discharging the scrap, the box main body 2 can be placed at a constant position with respect to the container at ail times.

Figure 6:
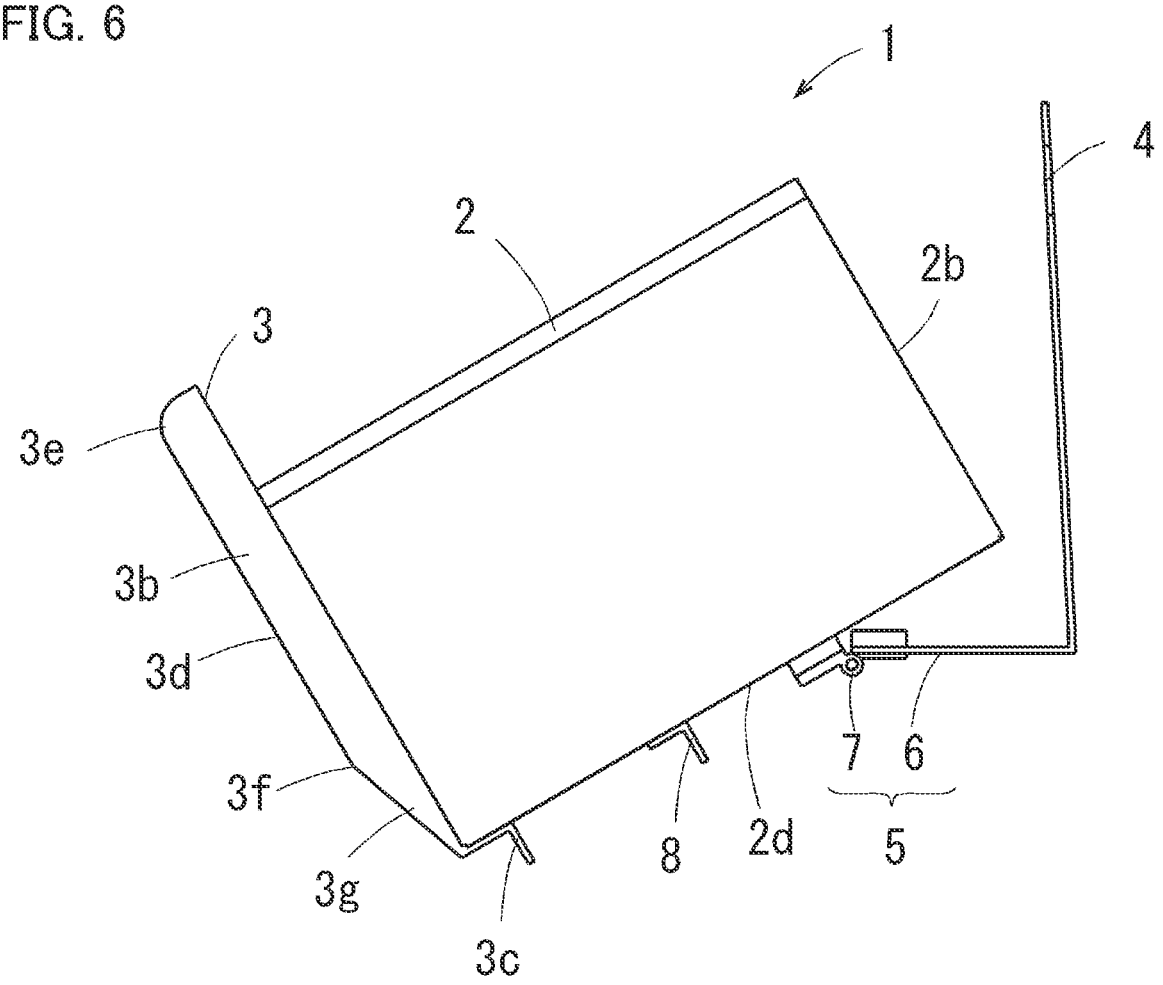
FIG. 6 relates to the article reversing/discharging box and the method of using the article reversing/discharging box according to an embodiment, and is a side view of the article reversing/discharging box in which a box main body is rotating.

FIG. 6 is a side view of the scrap box 1 in which the box main body 2 is rotating. The box main body 2 is turnable about the hinge 7 by the reversing mechanism 5. Accordingly, the scrap can be discharged from the accommodation space 2*a* of the box main body 2, and the box main body 2 can be returned to the original state.

Figure 7:
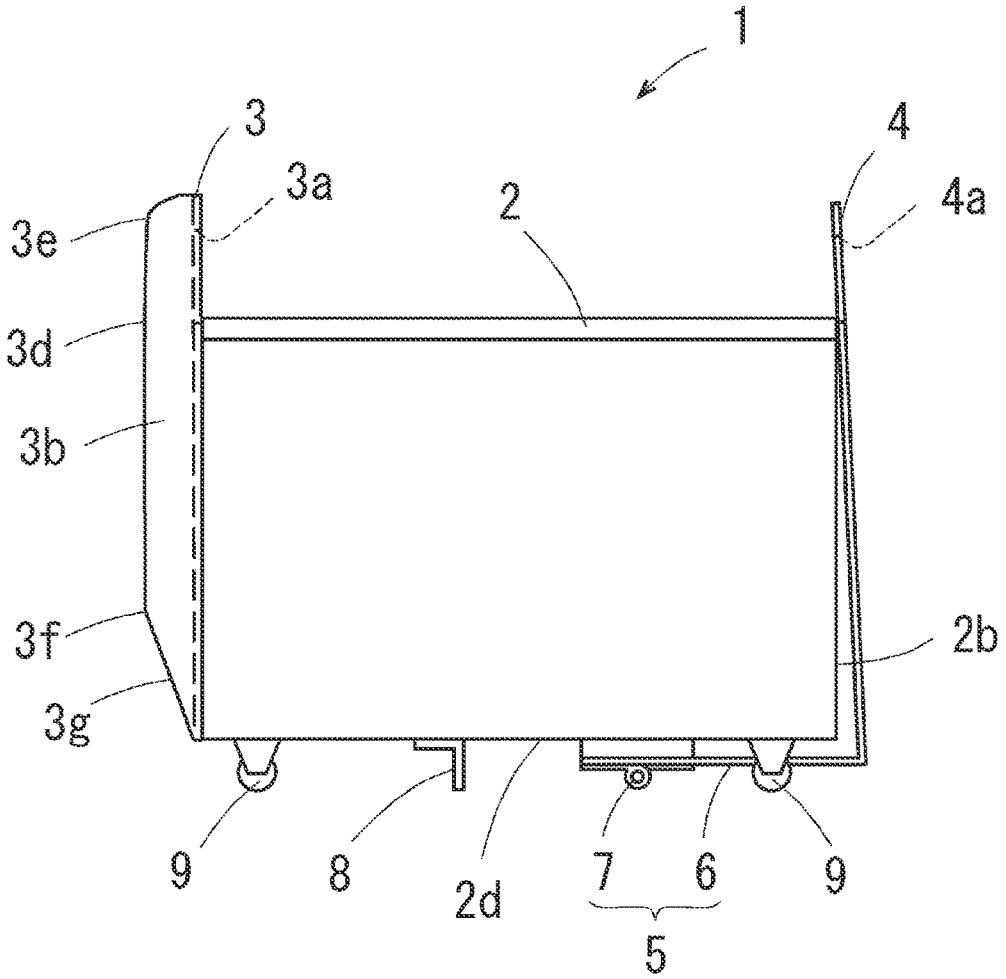
FIG. 7 relates to the article reversing/discharging box and the method of using the article reversing/discharging box according to an embodiment, and is a side view of another article reversing/discharging box.

Instead of the leg portion 3*c*, a caster 9 shown in FIG. 7 can be attached to the bottom surface 2*d* of the box main body 2. The bottom surface 2*d* of the box main body 2 can also be separated from the floor surface or the ground by the caster 9. In addition, when the forks are lowered to lower the scrap box 1 to the floor surface or the ground and return the box main body 2 to the original state, the box main body 2 can be appropriately moved by the caster 9, so that the work is facilitated.

Figure 8:
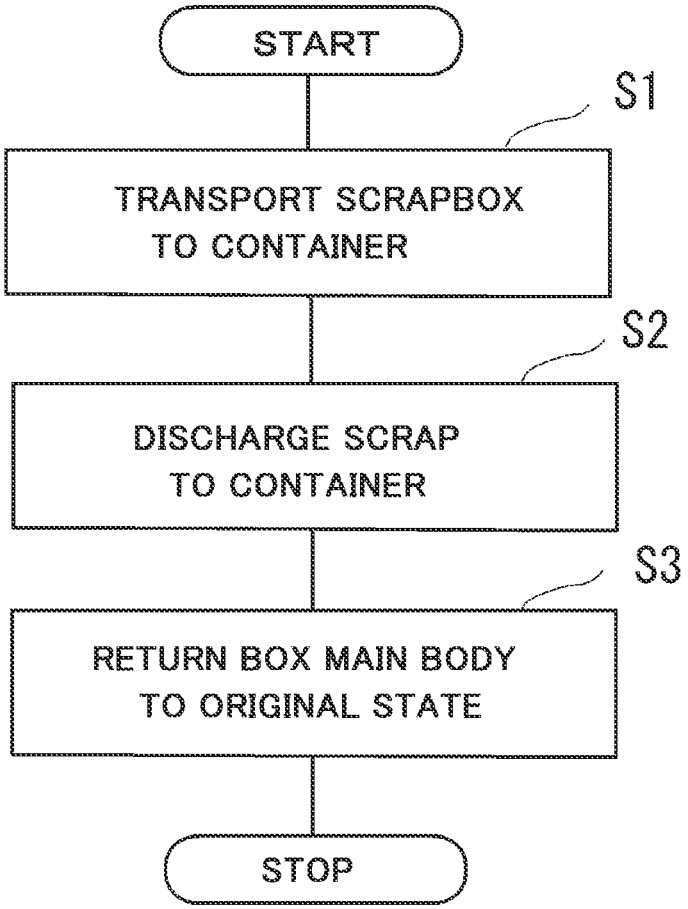
FIG. 8 is a flowchart of a method of using the article reversing/discharging box according to the embodiment.
Figure 9:
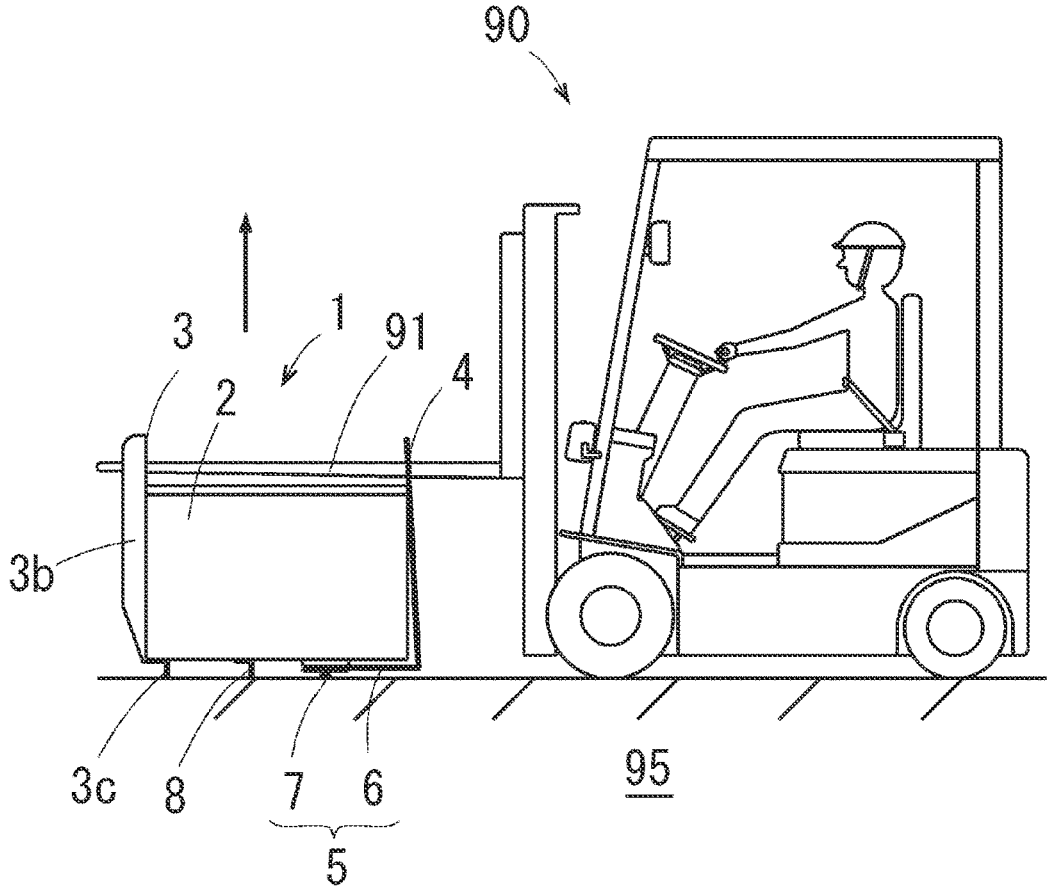
FIG. 9 relates to the method of using the article reversing/discharging box according to an embodiment, and is a view of the article reversing/discharging box in the transport process.

Next, a method of using the scrap box 1 having the above configuration will be described with reference to a flowchart illustrated in FIG. 8. First, in step S1, as illustrated in FIG. 9, the forks 91 of the forklift 90 are inserted into the insertion holes 3*a* and 4*a* of the scrap box 1 filled with scraps. Then, the forks 91 are raised to lift the scrap box 1, and the scrap box 1 is transported to the container 93 which is an article discharge place illustrated in FIG. 10. This step S1 is a transport process.

Figure 10:
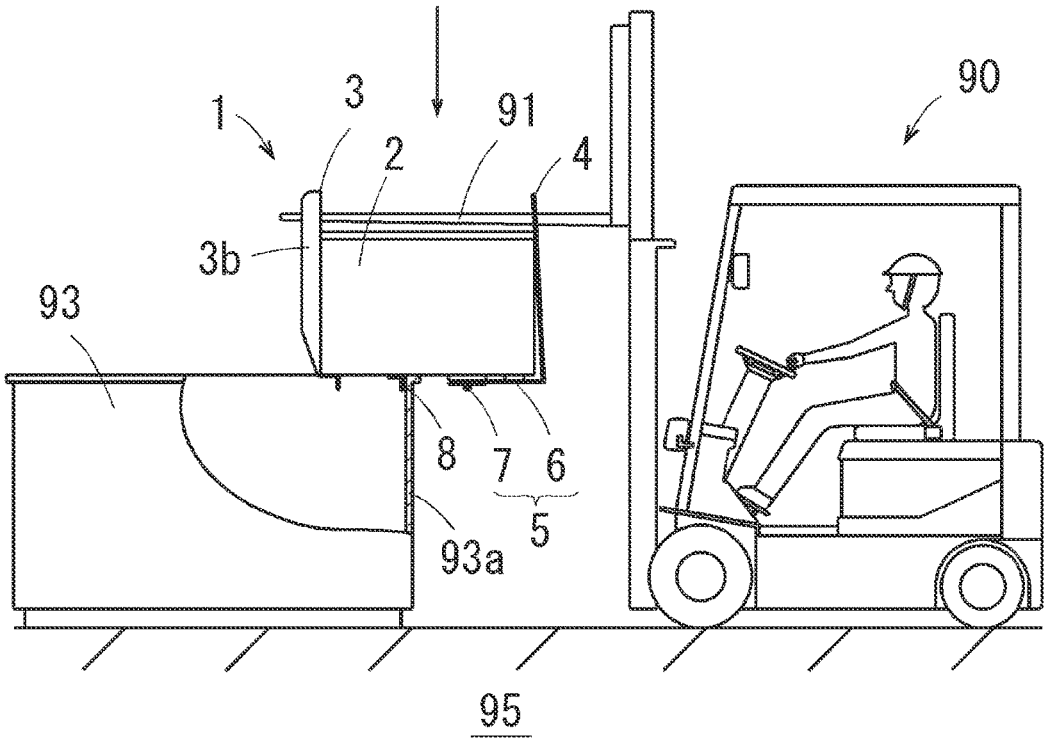
FIG. 10 relates to the method of using the article reversing/discharging box according to an embodiment, and is a view of the article reversing/discharging box in the discharge process.

In step S2, as illustrated in FIG. 10, the forks 91 are lowered as indicated by an arrow, and the stopper 8 of the box main body 2 is brought into contact with the upper end of the wall surface 93*a* of the container 93. In this manner, the box main body 2 can be placed on the container 93 at a constant position at all times, and scrap can be safely and reliably discharged from the box main body 2.

Figure 11:
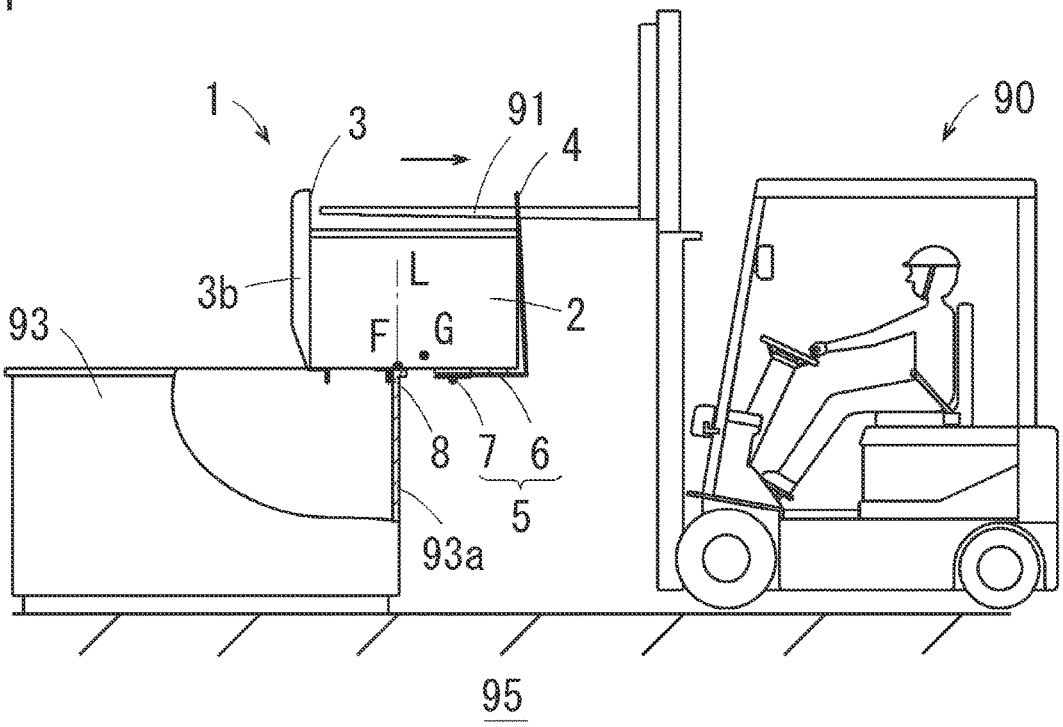
FIG. 11 relates to the method of using the article reversing/discharging box according to an embodiment, and is a view of the article reversing/discharging box in the discharge process.

Then, as illustrated in FIG. 11, the forklift 90 is moved backward, and the forks 91 are removed from the insertion holes 3*a* of the fixed hook members 3 while the forks 91 are inserted into the insertion holes 4*a* of the movable hook member 4. In this state, the center of gravity G of the box main body 2 is on the right side in the drawing of the vertical line L of the fulcrum F, and the movable hook member 4 is supported by the forks 91, so that the box main body 2 is stabilized while maintaining the horizontal state. The fulcrum F is a point at which the stopper 8 abuts on the upper end of the wall surface 93*a*.

Figure 12:
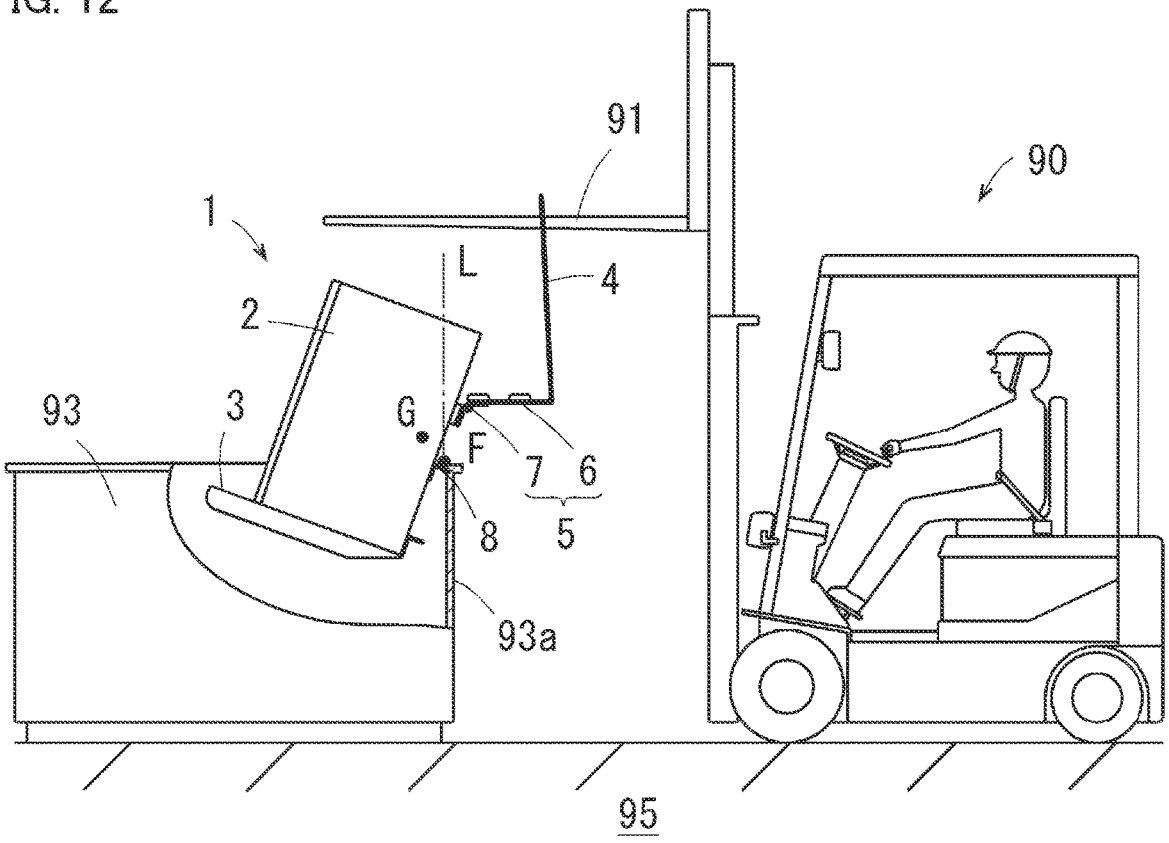
FIG. 12 relates to the method of using the article reversing/discharging box according to an embodiment, and is a view of the article reversing/discharging box in the discharge process.
Figure 13:
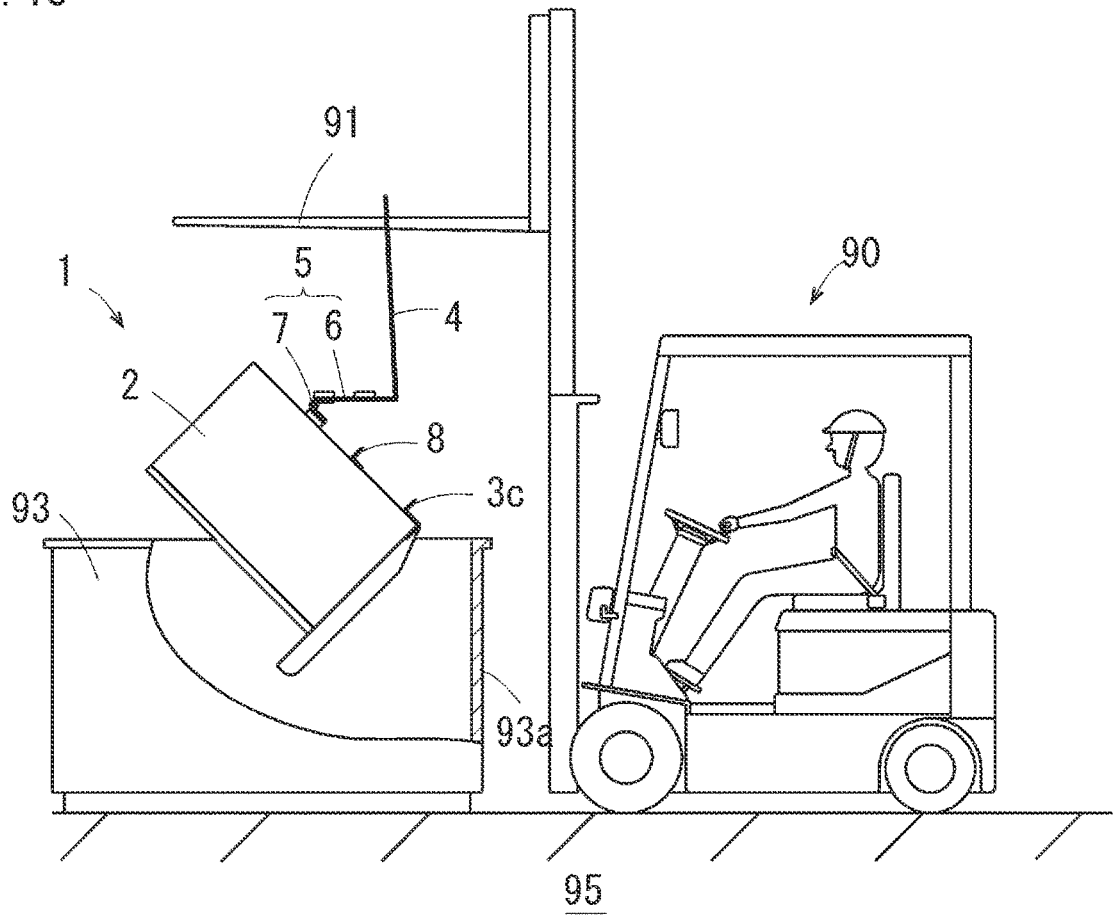
FIG. 13 relates to the method of using the article reversing/discharging box according to an embodiment, and is a view of the article reversing/discharging box in the discharge process.

As illustrated in FIG. 12, when the forks 91 are gradually raised, the center of gravity G of the box main body 2 slowly moves to the left side in the drawing of the vertical line L of the fulcrum F. Accompanying therewith, the box main body 2 also rotates slowly, and the scrap in the accommodation space 2*a* is gradually discharged. When the forks 91 are further raised, as shown in FIG. 13, the box main body 2 is completely reversed, and all the scraps in the accommodation space 2*a* are discharged. Since the rotation angle of the box main body 2 is 120 degrees or more, the scrap is sufficiently discharged, and the worker does not need to manually scrape out the remaining scrap. Here, step S2 is the discharge process.

Figure 14:
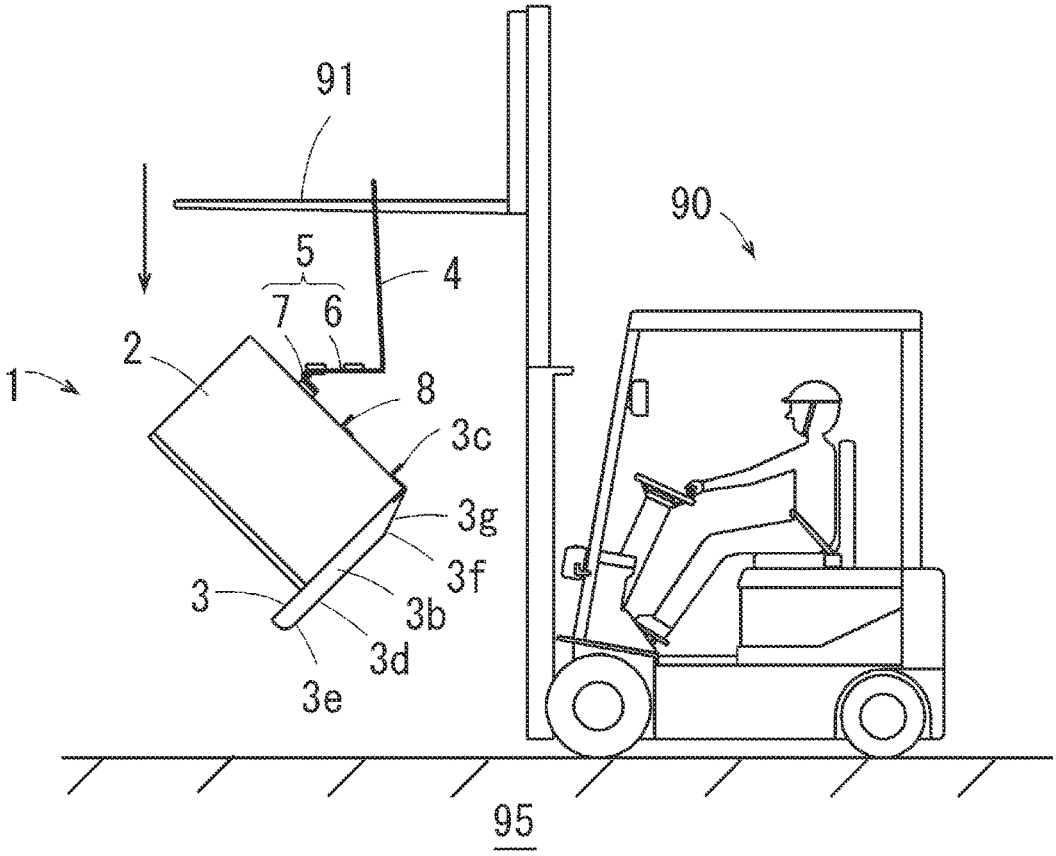
FIG. 14 relates to the method of using the article reversing/discharging box according to an embodiment, and is a view of the article reversing/discharging box in the return process.
Figure 15:
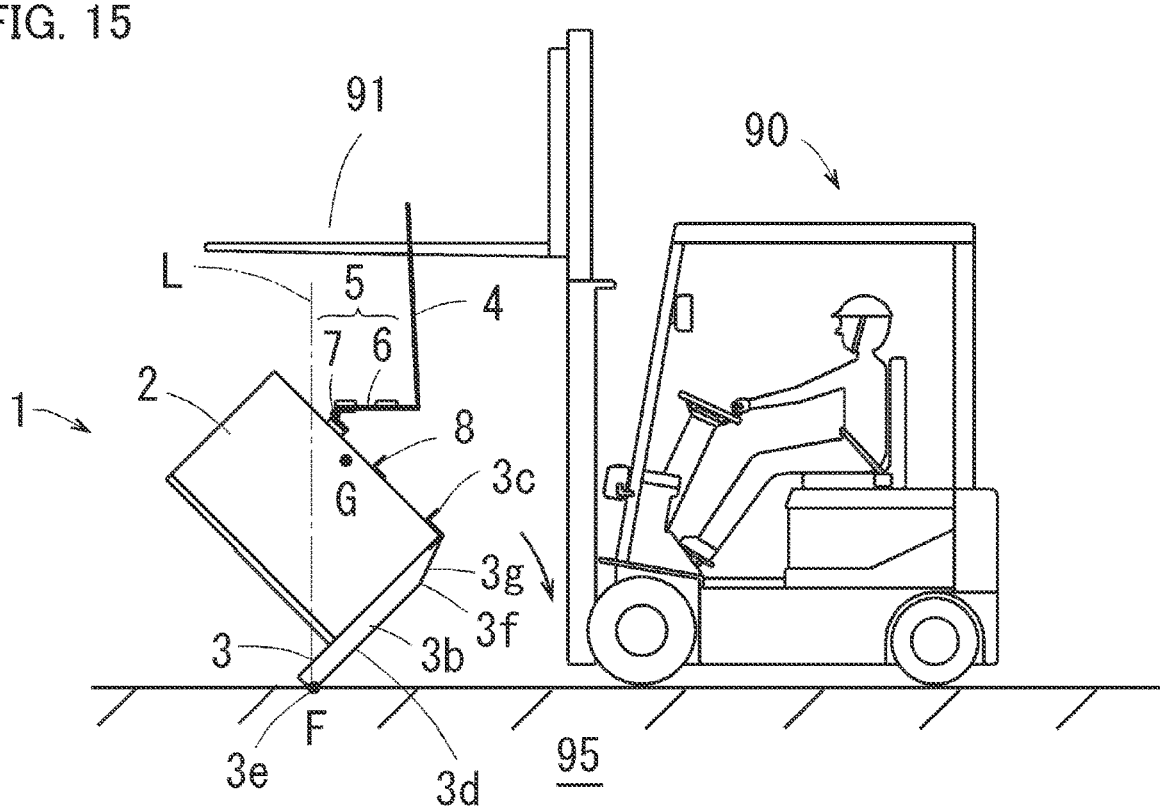
FIG. 15 relates to the method of using the article reversing/discharging box according to an embodiment, and is a view of the article reversing/discharging box in the return process.
Figure 16:
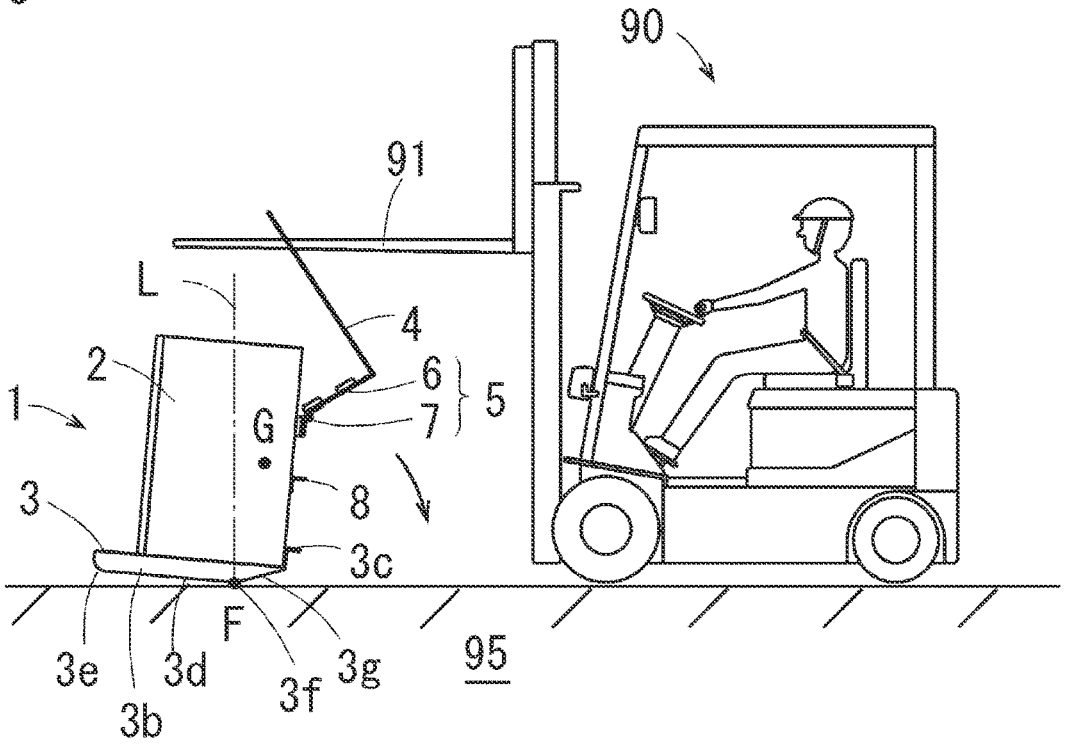
FIG. 16 relates to the method of using the article reversing/discharging box according to an embodiment, and is a view of the article reversing/discharging box in the return process.

In step S3, as illustrated in FIG. 14, the forklift 90 is moved backward to separate the scrap box 1 from the container 93, and the forks 91 are lowered. As shown in FIG. 15, when the box main body 2 reaches the floor surface 95, the first fulcrum portion 3*e* of the turn assisting member 3*b* first abuts on the floor surface 95, and this portion becomes the fulcrum F. At this time, since the center of gravity G of the box main body 2 is the on right side in the drawing of the vertical line L of the fulcrum F, the box main body 2 rotates in the clockwise direction as indicated by the arrow. When the forks 91 are further lowered, the fulcrum F moves to the second fulcrum portion 3*f* of the turn assisting member 3*b* as illustrated in FIG. 16. Since the turn assisting member 3*b* is provided with the inclined portion 3*g* gently inclined toward the box main body 2, the center of gravity of the box main body 2 is on the right side in the drawing of the vertical line L of the fulcrum F, and the box main body 2 rotates in the clockwise direction as indicated by the arrow.

Figure 17:
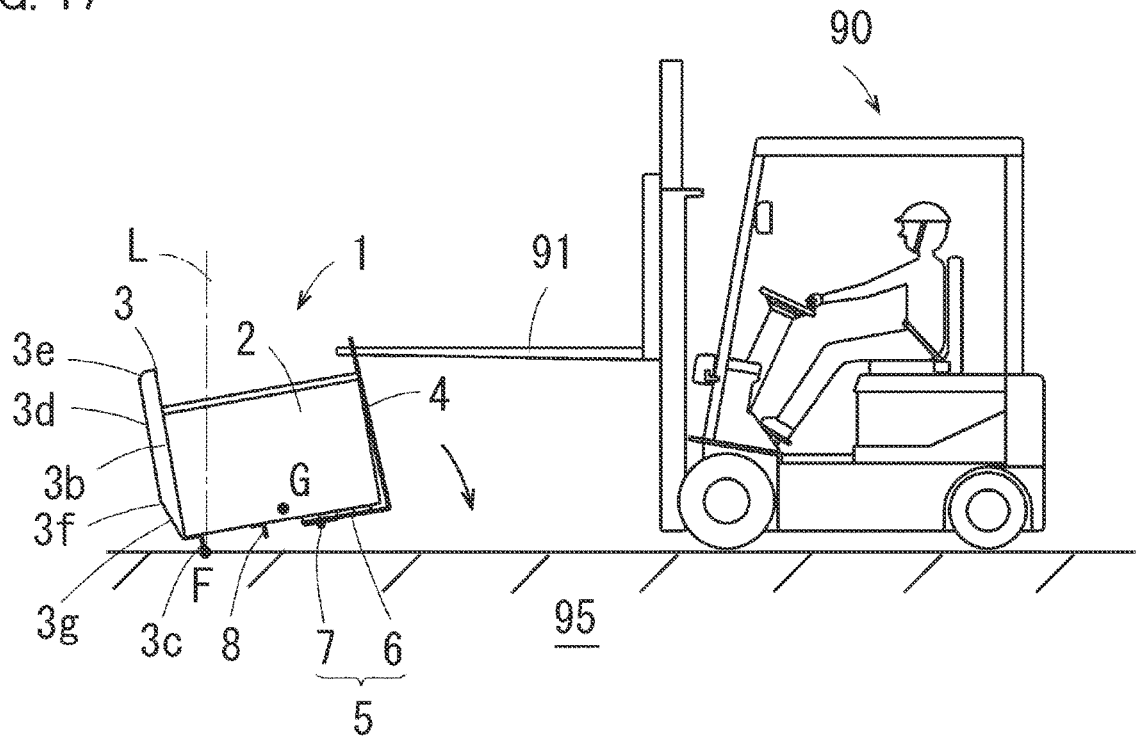
FIG. 17 relates to the method of using the article reversing/discharging box according to an embodiment, and is a view of the article reversing/discharging box in the return process.
Figure 18:
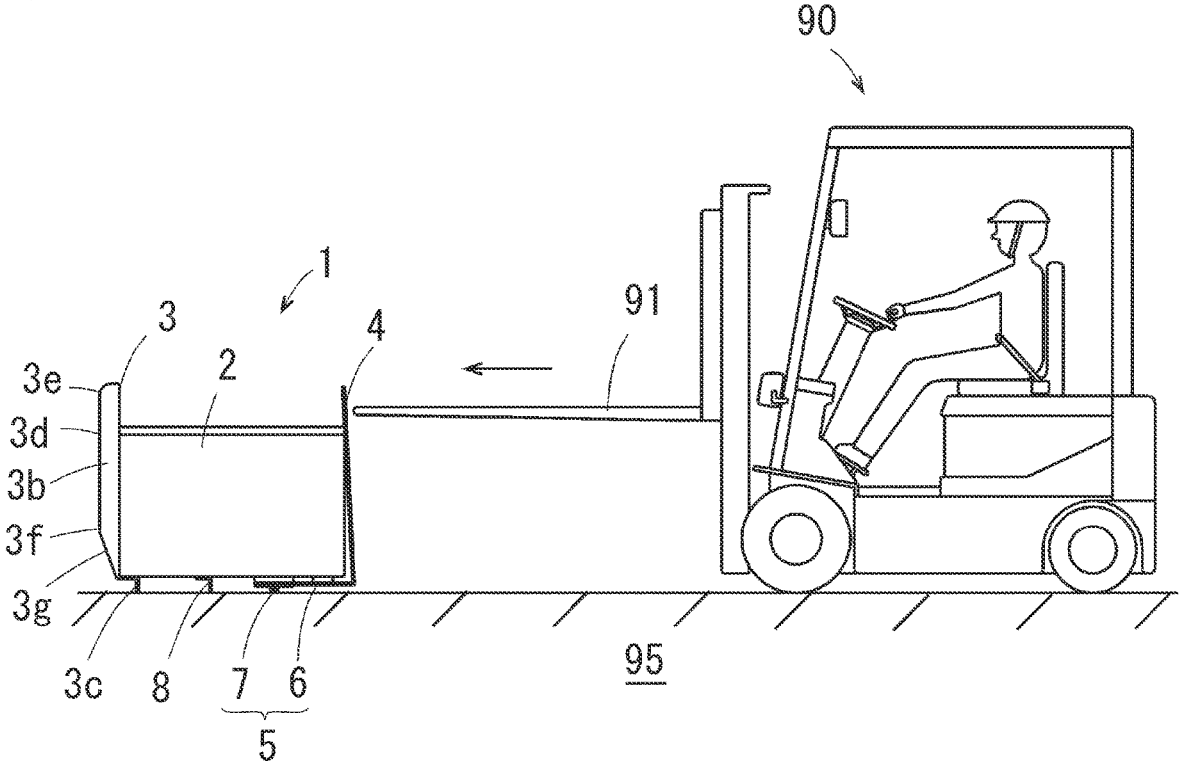
FIG. 18 relates to the method of using the article reversing/discharging box according to an embodiment, and is a view of the article reversing/discharging box in the return process.
Figure 19:
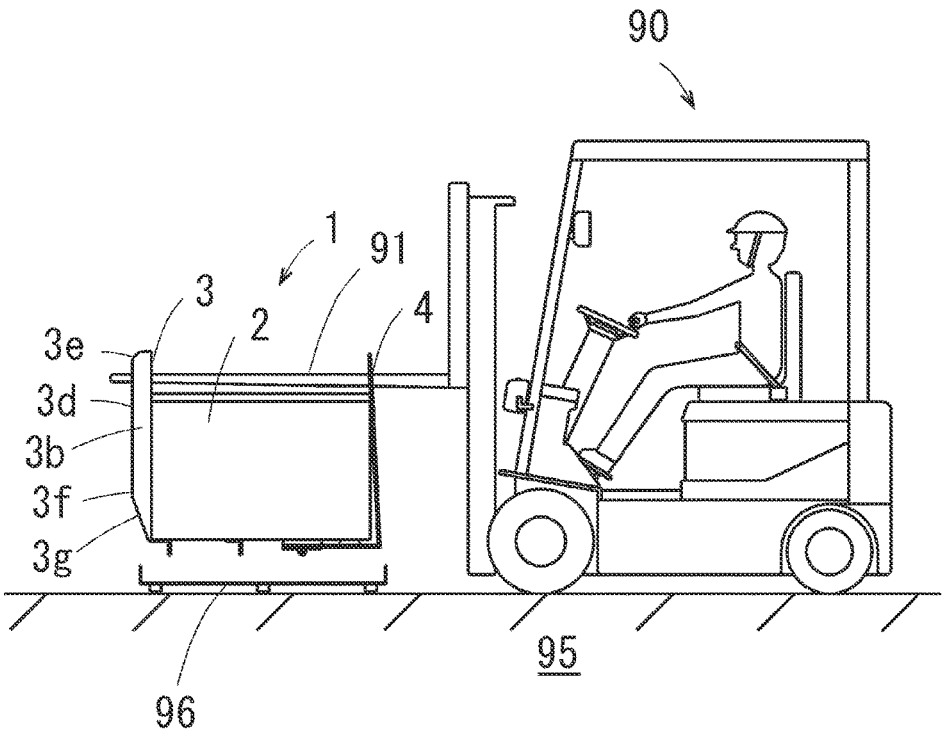
FIG. 19 relates to the method of using the article reversing/discharging box according to an embodiment, and is a view of the article reversing/discharging box in the return process.

When the forks 91 are further lowered, the fulcrum F moves to the lower end of the leg portion 3*c* as illustrated in FIG. 17. Since the center of gravity of the box main body 2 is on the right side in the drawing of the vertical line L of the fulcrum F, the box main body 2 rotates in the clockwise direction as indicated by an arrow, and the box main body 2 is completely placed on the floor surface 95. Thereafter, as illustrated in FIG. 18, the forks 91 are inserted into the insertion holes 3*a* and 4*a* of the fixed hook members 3 and the movable hook member 4. Then, the forks 91 are raised to lift the scrap box 1, and the scrap box 1 is transported to a predetermined position. When a carriage 96 with free bare (free ball bearing) illustrated in FIG. 19 is used, the scrap box 1 can be easily transported to a target place where the scrap box 1 is used. Furthermore, when the scrap box 1 to which the caster 9 illustrated in FIG. 7 is attached is used, the scrap box 1 can be easily transported to a target place where the scrap box 1 is used without using the carriage 96 with free bare (free ball bearing). This step S3 is a return process.

According to the article reversing/discharging box 1 of the embodiment, when the forks 91 are inserted into the insertion holes 4*a* of the movable hook member 4 and the forks 91 are removed from the insertion holes 3*a* of the fixed hook members 3, the box main body 2 is turnable about the distal end portion of the bottom plate 2*d* by the hinge 7. Thus, when the worker removes the forks 91 from the insertion holes 3*a* of the fixed hook members 3 while the forks 91 are inserted into the insertion holes 4*a* of the movable hook member 4, the box main body 2 can be reversed or returned to the original state. Therefore, the worker can perform a series of works from the conveyance of the article reversing/discharging box 1 to the discharge of the scrap and the return of the box main body 2 while riding on the forklift 90. Therefore, the worker does not get off the forklift 90 not even once in all of the processes of the discharging work, and does not touch the article reversing/discharging box 1. In addition, since the article reversing/discharging box 1 includes only the box main body 2, the hook members 3 and 4, and the reversing mechanism 5, the structure is simple and the number of parts is few. Therefore, according to the article reversing/discharging box 1, the load of the worker is reduced, the worker can perform the discharging work of scrap without getting off the forklift 90, and it can be inexpensively manufactured.

In addition, in the article reversing/discharging box 1, since the box main body 2 has a rectangular parallelepiped shape, it is easy to manufacture and also easy to handle. Furthermore, since the reversing member is the hinge 7, the structure is simple and inexpensive. Moreover, when the forks 91 are removed from the insertion holes 3*a* of the fixed hook members 3 while the forks 91 are inserted into the insertion holes 4*a* of the movable hook member 4, the box main body 2 can be easily reversed or returned to the original state.

In addition, in the article reversing/discharging box 1, the turn assisting member 3*b* that assists the turning of the box main body 2 is provided on the rear surface 2*c* of the box main body 2, and thus when the forks 91 are lowered to lower the article reversing/discharging box 1 to the floor surface 95, the box main body 2 can be easily returned to the original state.

Furthermore, in the article reversing/discharging box 1, since each of the fixed hook members 3 has the leg portion 3*c* formed by extending the fixed hook member 3 downward, the bottom surface 2*d* of the box main body 2 can be separated from the floor surface 95 with a simple structure. A similar effect can be obtained even by attaching the caster 9 instead of the leg portion 3*c*. In addition, in the article reversing/discharging box 1, since the stopper 8 for positioning to reverse the box main body 2 and discharge the scrap is attached to the bottom surface 2*d* of the box main body 2, the scrap can be reliably and easily discharged to a predetermined position.

In the method of using the article reversing/discharging box 1, in the transport process S1, the forks 91 of the forklift 90 are inserted into the insertion holes 3*a* and 4*a* of the hook members 3 and 4, and the article reversing/discharging box 1 is transported to the container 93 while being lifted up. In the discharge process S2, the worker removes the forks 91 from the insertion holes 3*a* of the fixed hook members 3 while the forks 91 are inserted into the insertion holes 4*a* of the movable hook member 4, and then reverses the box main body 2 with the hinge 7 to discharge the scrap. Furthermore, in the return process S3, the box main body 2 is returned to the original state by the hinge 7. Thus, when the worker removes the forks 91 from the insertion holes 3*a* of the fixed hook members 3 while the forks 91 are inserted into the insertion holes 4*a* of the movable hook member 4, the box man body 2 can be reversed or returned to the original state. Therefore, the worker can perform a series of works from the conveyance of the article reversing/discharging box 1 to the discharge of the scrap and the return of the box main body 2 while riding on the forklift 90. Therefore, the worker does not get off the forklift 90 not even once in all of the processes of the discharging work, and does not touch the article reversing/discharging box 1. Therefore, according to the method of using the article reversing/discharging box 1, the load of the worker is reduced, and the worker can perform the discharging work of scrap without getting off the forklift 90.

Although the article reversing/discharging box and the method of using the article reversing/discharging box of the present invention have been described in accordance with the embodiment, the present invention is not limited thereto, and it goes without saying that the present invention can be appropriately modified and applied as long as it does not contradict the technical idea of the present invention. For example, in the present embodiment, the article discharge place is the container 93, but the article discharge place is not particularly limited, and for example, a blue sheet laid on the ground, a pit dug in the ground, or the like can be efficiently used.

REFERENCE SIGNS LIST

1 article reversing/discharging box
2 box main body
2*b* front surface
2*c* rear surface
2*d* bottom surface
3, 4 hook member
(3 fixed hook member, 4 movable hook member)
3*a*, 4*a* insertion hole
3*b* turn assisting member
3*c* leg portion
5 reversing mechanism
(6 bottom plate, 7 reversing member (hinge))
8 stopper
9 caster
90 forklift
91 fork
93 article discharge place (container)
S1 transport process
S2 discharge process
S3 return process

The invention claimed is:

1. An article reversing/discharging box that is reversed by a forklift to discharge an accommodated article, the article reversing/discharging box comprising:

a box main body that accommodates the article; hook members that are provided facing the box main body and have insertion holes through which forks of the forklift are inserted above the box main body; and a reversing mechanism capable of reversing the box main body, wherein the box main body includes a bottom surface having a flat surface shape, a first wall surface provided upright on an outer periphery of the bottom surface, and a second wall surface provided upright on an outer periphery of the bottom surface facing the first wall surface, the hook members include fixed hook members that are fixed to the second wall surface, and a movable hook member that is provided on the first wall surface and extends upward from a lower end of the box main body along the first wall surface, the reversing mechanism includes a bottom plate integrally extending from a lower end of the movable hook member along the bottom surface, and a reversing member provided at a distal end portion of the bottom plate, and when the forks are inserted into the insertion holes of the movable hook member and the forks are removed from the insertion holes of the fixed hook members, the box main body is turnable about the distal end portion of the bottom plate by the reversing member.

2. The article reversing/discharging box according to claim 1, wherein the box main body has a rectangular parallelepiped shape.

3. The article reversing/discharging box according to claim 1, wherein the reversing member is a hinge.

4. The article reversing/discharging box according to claim 1, wherein the second wall surface of the box main body is provided with a turn assisting member that assists the turning of the box main body.

5. The article reversing/discharging box according to claim 1, wherein the fixed hook members each have a leg portion formed by extending the fixed hook member downward.

6. The article reversing/discharging box according to claim 1, wherein casters are attached to the bottom surface of the box main body.

7. The article reversing/discharging box according to claim 1, wherein a stopper for positioning to reverse the box main body and discharge an article is attached to the bottom surface of the box main body.

8. A method of using an article reversing/discharging box using the article reversing/discharging box according to claim 1, the method comprising:

a transport process of inserting the forks of the forklift into the insertion holes of the hook members of the article reversing/discharging box in which an article is accommodated, and then transporting the article reversing/discharging box to an article discharge place while lifting the article reversing/discharging box;

a discharge process of removing the forks from the insertion holes of the fixed hook members while the forks are inserted into the insertion holes of the movable hook member at a predetermined position of the article discharge place, and reversing the box main body to discharge the article; and a return process of returning the box main body to an original state.

* * * * *